US007255669B2

(12) United States Patent
Shimizu et al.

(10) Patent No.: US 7,255,669 B2
(45) Date of Patent: Aug. 14, 2007

(54) CENTRIFUGE WITH IMBALANCE DETECTOR

(75) Inventors: Takahiro Shimizu, Hitachinaka (JP); Yoshitaka Niinai, Hitachinaka (JP); Shoji Kusumoto, Hitachinaka (JP); Hiroyuki Takahashi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/960,716

(22) Filed: Oct. 8, 2004

(65) Prior Publication Data

US 2005/0079064 A1 Apr. 14, 2005

(30) Foreign Application Priority Data

Oct. 9, 2003 (JP) ..... P2003-350561

(51) Int. Cl.
*B04B 9/10* (2006.01)
*B04B 13/00* (2006.01)

(52) U.S. Cl. ..... 494/9; 494/82

(58) Field of Classification Search ..... 494/1, 494/7–12, 16–21, 31, 33, 82–84; 210/85, 210/144, 363; 74/572.4; 318/460, 470; 324/162; 68/23.1, 23.3, 12.06; 73/66, 457, 73/460, 462, 468

See application file for complete search history.

(56) References Cited

U.S. PATENT DOCUMENTS 2,666,572 A * 1/1954 Pickels
2,895,023 A * 7/1959 Blum
3,101,322 A * 8/1963 Stallman et al.
3,422,957 A * 1/1969 Fosler
3,676,723 A * 7/1972 Drucker
3,699,287 A * 10/1972 Stahl et al.
4,214,179 A * 7/1980 Jacobson et al.
4,455,461 A * 6/1984 Maguire
4,910,502 A * 3/1990 Serveau et al.
5,160,876 A * 11/1992 Niinai et al.
5,496,254 A * 3/1996 Keller et al.
5,659,136 A * 8/1997 Koch et al.
5,800,331 A * 9/1998 Song
6,062,078 A * 5/2000 Meisberger
7,055,368 B2 * 6/2006 Schneider et al. ..... 494/10
7,115,090 B2 * 10/2006 Lagarde ..... 494/10

FOREIGN PATENT DOCUMENTS

GB 2146784 A * 4/1985
JP 6-230023 * 8/1994
JP 2006-7093 * 1/2006

* cited by examiner

*Primary Examiner*—Charles E. Cooley
(74) *Attorney, Agent, or Firm*—Antonelli, Terry, Stout & Kraus, LLP.

(57) ABSTRACT

A centrifuge includes a frame, a damper connected to and supported on the frame for isolating vibrations, a drive unit connected to and supported by the damper, a swing-bucket rotor rotated by the drive unit, an accelerometer for detecting when part of the drive unit contacts part of the frame due to vibrations of the drive unit exceeding a predetermined amplitude, and a control unit for controlling the drive unit based on output from the accelerometer. When amplitude of vibrations in the drive unit exceeds a predetermined value, a portion of the drive unit contacts a portion of the frame. The accelerometer detects an impact caused by the contact between the drive unit and the frame. The drive unit is halted when output detected from the accelerometer exceeds a threshold value for detecting imbalances.

16 Claims, 7 Drawing Sheets

CENTRIFUGE WITH IMBALANCE DETECTOR

BACKGROUND OF THE INVENTION

1. Field of the Invention

The present invention relates to a centrifuge, and more particularly to a centrifuge used for a sample separation.

2. Description of Related Art

In a conventional centrifuge, torque is produced by a power generator (generally an electric motor) that is part of a drive unit, and transferred to a rotor via a rotating shaft, causing the rotor to rotate. There are several types of rotors used for this type of centrifuge according to the type and amount of sample being separated and the like. These rotor types include a fixed-angle rotor provided with a plurality of holes at fixed angles for holding sample tubes that have been injected with samples, a swing-bucket rotor having vessels called buckets that are swingably supported on rotor arms so as to be able to swing independently while the rotor arms rotate and capable of holding a plurality of sample tubes, and a horizontal rotor in which sample tubes are mounted in a horizontal state.

In general, a rotor suitable for the intended purpose is selected from one of the above rotors. Vessels, such as sample tubes that have been injected with a sample, are inserted into the rotor, and the rotor is rotated, generating a centrifugal force for separating the sample or for shaking off droplets or the like deposited on the side walls of the sample tubes. However, since the user is responsible for injecting samples in the tubes and inserting sample tubes into the rotor, the manufacturer cannot guarantee a precise balance in the rotor.

For example, blood tests, which are widely used for medical diagnoses and the like, generally employ vacuum blood collection tube for drawing blood from the patient. However, the amount of blood that is drawn depends upon the patient and the person drawing the blood, and the evacuated tubes mounted in the rotor vary in number and weight. As a result, the centrifuge commonly operates in an imbalanced state, even when the user takes balance into consideration. Accordingly, manufacturers have been committed to developing sturdy devices that can withstand imbalances as much as possible and design devices that can allow imbalances to a certain degree.

If the imbalance exceeds a predetermined amount, then the force of the imbalance that increases as the rotations increase has an adverse effect on the bearing supporting the rotating shaft, which can bend the rotating shaft or cause other problems. Further, it is inevitable that imbalance exceeds the allowable amount when the user mistakenly injects the wrong amount of a sample or inserts the sample tubes in the wrong sample tube holes. Accordingly, most centrifuges are provided with sensors for detecting vibrations or amplitude. When the sensors detect that the centrifuge is operating in a state of imbalance exceeding the tolerable amount, the centrifuge halts rotations of the rotor before the device malfunctions.

One such sensor is an accelerometer that is mounted on the drive unit in the centrifuge for measuring accelerations to detect wobble (vibration or oscillation during rotation) in the rotor caused by an imbalance. The accelerometer is now being used for detecting vibrations caused by imbalances exceeding the tolerable amount and abnormal vibrations caused by operator error. (For example, some centrifuges generate self-excited vibration when the user does not firmly fix the rotor onto the rotating shaft.) However, the output obtained by an accelerometer is acceleration, calculated as follows.

$$\alpha = -A\omega^2 \sin \omega t$$ ($\alpha$: acceleration, A: amplitude, $\omega$: angular velocity)

Hence, output for acceleration at low speeds (when $\omega$ is small) is low, making it difficult to establish a threshold for detecting vibrations.

Japanese patent application publication No. 2002-306989 (kokai) discloses a technique for overcoming this deficiency, wherein an amplification circuit is provided for amplifying signals outputted by the accelerometer, and the gain is modified according to the rotational speed.

By amplifying output at low speeds using the technique described above, detection near the resonance point (Nc) at low speeds is possible. This technique can also incorporate other techniques, such as varying the threshold for detecting imbalance based on the type of rotor. Hence, this technology has begun to be employed in a wide variety of centrifuges. With this method, a simple construction can be used to detect with great accuracy imbalances exceeding the allowable amount according to design specifications.

SUMMARY OF THE INVENTION

However, the above-described centrifuge has difficulty detecting when the centrifuge is running in a state of excessive imbalance. For example, Hitachi Koki Co., Ltd. manufactures a T3S6 swing-bucket rotor formed in a cross-shape with four buckets hanging therefrom. The maximum rotational speed of the rotor is 3,000 rpm. While the allowable imbalance according to the design specifications differs according to the centrifuge being used, in general an imbalance between opposing buckets can be no more than 20-30 grams. Accordingly, if imbalances are detected using an accelerometer according to the method described above, imbalances of about 30-40 grams can be detected. Further, it is possible to detect when the user has forgotten to insert one sample tube (an imbalance as large as several tens of grams to one hundred and several tens of grams), display an alert message on a display unit of the centrifuge indicating abnormality, and halt the rotor.

However, if a user forgets to mount a bucket, which when including samples exceeds 900 grams, the rotor will wobble excessively, even at such extremely low velocities of from several ten rpm to more than one hundred rpm. Since acceleration is proportional to the square of angular velocity, as described above, the signal from the accelerometer is weak at very low velocities, making it difficult to detect even when amplified. Although the abnormality is detected when the rotor speeds up to several hundred rpm, by this time the buckets and the like are likely already wobbling excessively and causing damage.

In view of the foregoing, it is an object of the present invention to provide a centrifuge capable of compensating for deficiencies in detecting vibrations and capable of stopping the rotor before damage occurs.

In order to attain the above and other objects, the present invention provides a centrifuge. The centrifuge includes a frame, a damper, a drive unit, a rotating member, a detecting unit, and a control unit. The frame has a first portion. The damper is supported by the frame. The drive unit is supported by the damper and generates a rotational force. The drive unit has a second portion. The rotating member is connected to the drive unit and is rotated by the rotational force. Imbalance of the rotating member causes the drive unit to vibrate during the rotation. The first portion and the second portion are positioned such that the second portion contacts the first portion when the vibration of the drive unit exceeds a predetermined amplitude. The detecting unit detects an impact caused when the second portion contacts the first portion and generates, upon the detection, an output signal. The control unit controls the drive unit based on the output signal.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1:
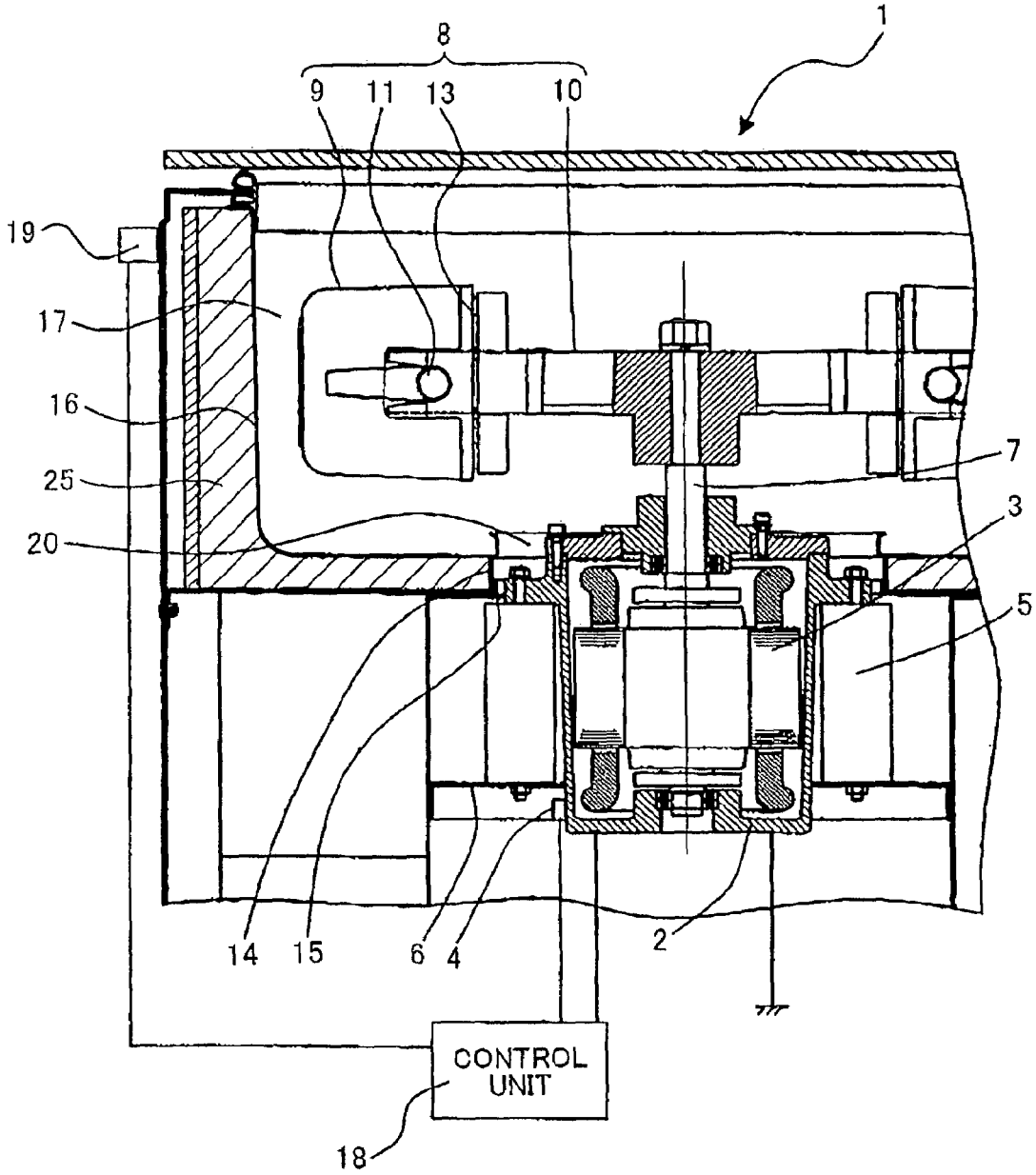
FIG. 1 is a side cross-sectional view showing a centrifuge according to a first embodiment of the present invention.

A centrifuge according to preferred embodiments of the present invention will be described while referring to the accompanying drawings wherein like parts and components are designated by the same reference numerals to avoid duplicating description.

A centrifuge according to a first embodiment of the present invention will be described with reference to FIGS. 1 through 7, FIG. 1 is a cross-sectional view of a centrifuge 1 according to the first embodiment.

As shown in FIG. 1, the centrifuge 1 includes a frame 6 formed of a plate material or the like that has been bent into a substantially box shape. A chamber 16 is disposed on top of the frame 6 and contains a rotating space 17 therein. The chamber 16 is surrounded by a sound- and heat-insulating material, such as urethane foam 25. A ring 14 is disposed on the frame 6. An opening 20 corresponding to the ring 14 is formed at a central portion of the chamber 16 and fits over an outer periphery of the ring 14 to fix the chamber 16 on the frame 6. By packing the urethane foam 25 around the installation location of the chamber 16, the chamber 16 can be formed integrally with the frame 6. However, the chamber 16 can be fixed to the frame 6 using screws or the like to form the chamber 16 and the frame 6 integrally.

Figure 4:
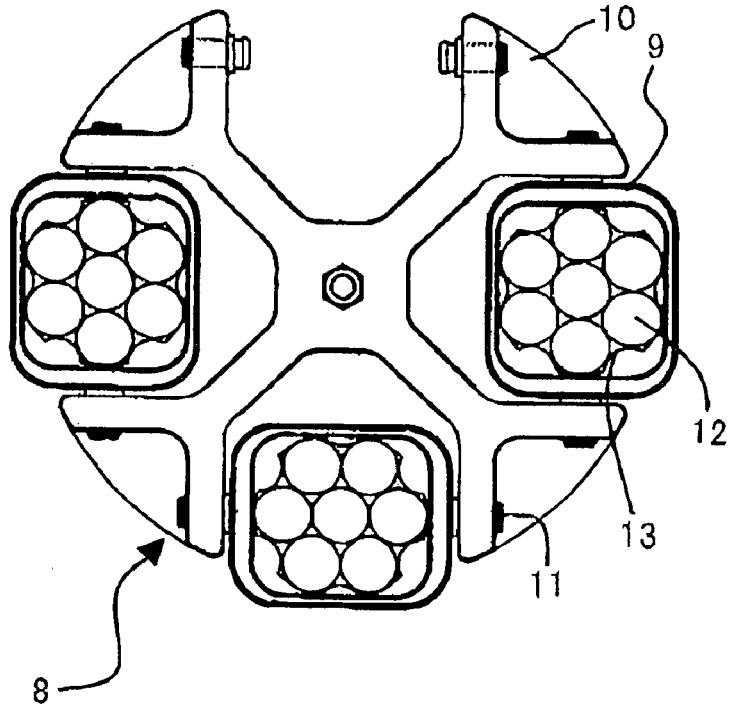
FIG. 4 is a plan view showing a swing-bucket rotor in the centrifuge of the first embodiment.

A drive unit 2 having a rotating shaft 7 is supported on a portion of the frame 6 such that the rotating shaft 7 protrudes upward through the opening 20. A damper 5 incorporating a spring (not shown) for isolating vibrations is interposed between the frame 6 and the drive unit 2 and dampens vibrations by expanding and contracting. An induction motor 3 serves as the drive source of the drive unit 2. A cross-shaped rotor body 10, which is part of a swing-bucket rotor 8, is mounted on the top end of the rotating shaft 7 that protrudes from the induction motor 3. Buckets 9 are provided between rotor arms of the rotor body 10. The buckets 9 hook onto pins 11 provided on the rotor body 10. When the rotor body 10 begins to rotate, the buckets swing about the pins 11 from a downward hanging direction following the force of gravity to a horizontal direction following the centrifugal force. (FIG. 1 shows the buckets 9 swung outward along the direction of centrifugal force.) Racks 13 for accommodating sample tubes are mounted in each bucket 9. As shown in FIG. 4, the racks 13 are formed of a plastic material having a plurality of holes. Sample tubes 12 that have been injected with a sample are inserted into the holes of the racks 13 and undergo centrifugation as the rotor body 10 rotates.

Figure 2:
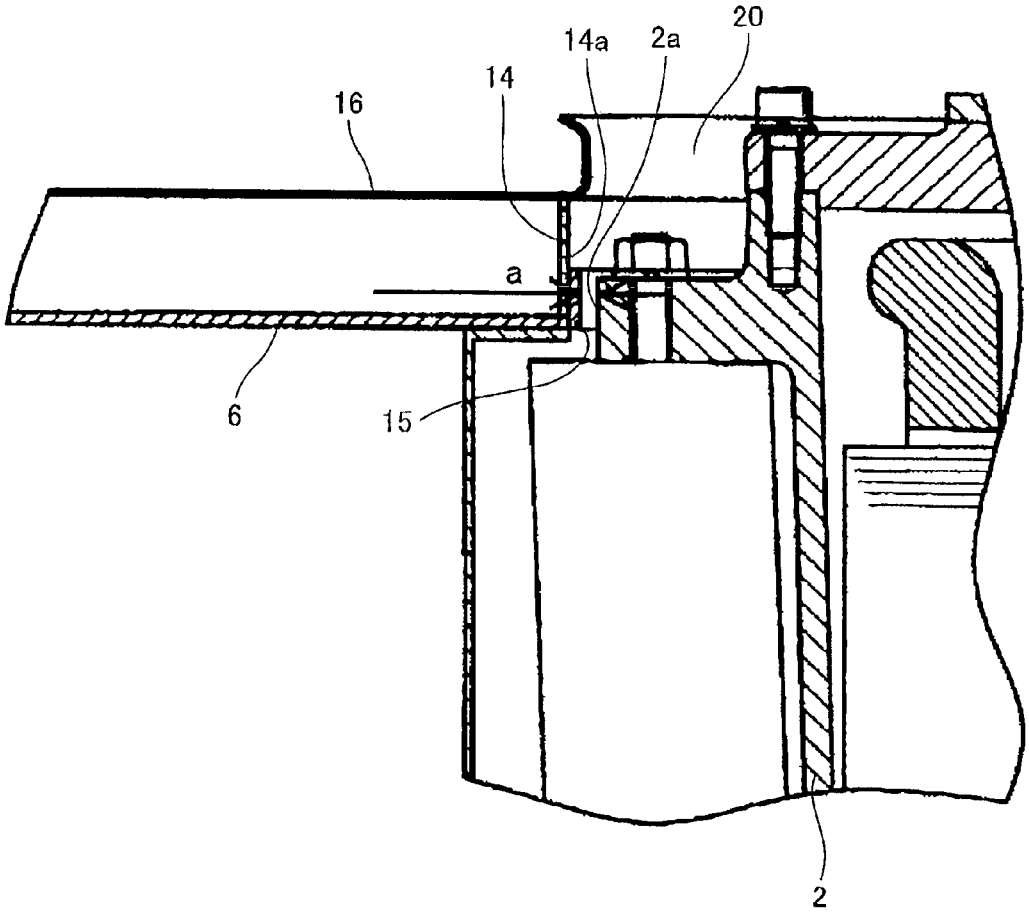
FIG. 2 is an enlarged cross-sectional view showing an area of the centrifuge near a ring and a portion of a drive unit according to the first embodiment.
Figure 3:
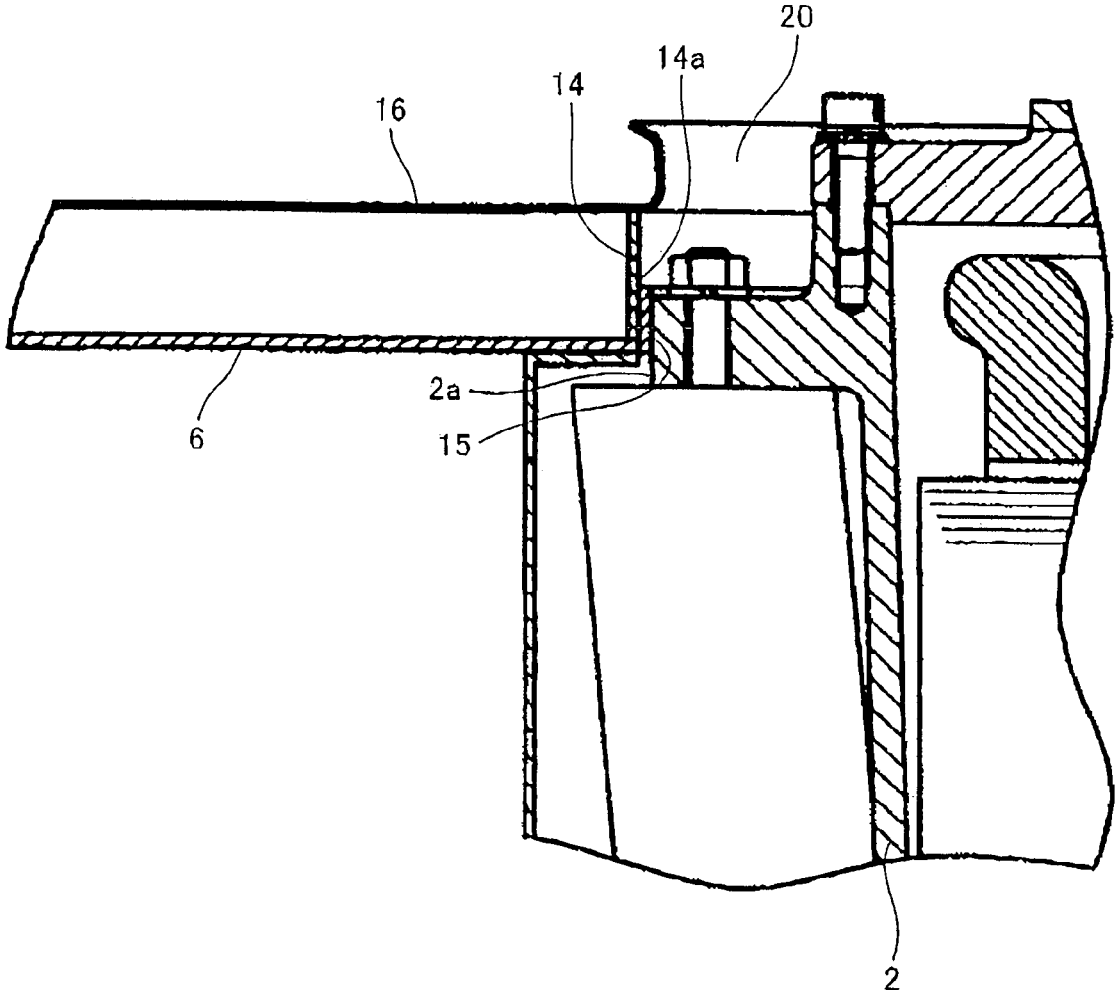
FIG. 3 is an enlarged cross-sectional view showing the centrifuge according to the first embodiment, in which the portion of the drive unit contacts the ring.

An accelerometer 4 is mounted on the bottom part of the drive unit 2, and includes a circuit that outputs a maximum voltage of 5 V according to movement of the drive unit 2. A control unit 18 is connected to the accelerometer 4. The control unit 18 detects a signal outputted from the accelerometer 4 and controls the rotation of the centrifuge 1 based on the detected signal. The control unit 18 is also connected to an alarm unit 19, which notifies the user of abnormalities in the centrifuge 1 through sound, lights, or the like. As shown in FIGS. 1, 2, and 3, the ring 14 is welded to the center portion of the frame 6. A ring 15 formed of plastic is disposed at an inner periphery portion 14*a* of the ring 14. A portion 2*a* of the drive unit 2 is positioned in confrontation with the ring 15, forming a predetermined gap a therebetween.

Next, a control process performed by the centrifuge 1 with the above-described construction will be described for a situation in which an imbalance occurs in the swing-bucket rotor 8. Generally, centrifuges whose primary function is to achieve stable rotation at high speeds are configured with slender rotating shafts. The slender rotating shafts lower the natural frequency for bending the rotating shaft, and thus move the resonance point (Nc) to a low speed. A self-aligning effect is used to achieve stable rotations at higher speeds exceeding the resonance point. Generally, the resonance point for bending the rotating shaft falls between several hundred rpm to a thousand and several hundred rpm.

In contrast, centrifuges whose primary function is to separate large amounts of samples at low speeds are configured of a thick rotating shaft having a natural frequency for bending the rotating shaft at a speed higher than the rotational speed range of its intended use, thereby improving operability and durability of the rotating shaft. However, since the rigidity of the rotating shaft is great in this case, a force of imbalance generated by the rotating shaft is transferred directly to the drive unit via the bearing and further transferred to the frame of the centrifuge, generating strong vibrations in the frame.

To prevent this problem, this type of centrifuge is provided with a damper and the like having isolating capabilities for supporting the drive unit on the frame. The damper isolates vibrations in the drive unit so the vibrations are not transferred to the frame. Hence, it is not possible to avoid an occurrence of resonance in a spring-mass system configured of a mass of the drive unit and a spring in the damper. While the damper performs some damping, all of the resonance effects cannot be eliminated completely. Accordingly, as in the system having the slender rotating shaft described above, resonance caused by the damper-mass system is commonly generated at several hundred rpm to a thousand and several hundred rpm. Thus, the accelerometer detects an imbalance near the resonance point. In other words, the centrifuge has a resonance point between several hundred rpm and a thousand and several hundred rpm, regardless the diameter of the rotating shaft.

Therefore, the centrifuge 1 according to the first embodiment detects commonly occurring imbalances based on signals outputted from the accelerometer 4 when the rotating shaft rotates between the one hundred rpm and a thousand and several hundred rpm range near the resonance point, and halts the rotor when an imbalance is detected. More specifically, assume that the swing-bucket rotor 8 is provided with racks 13 capable of accommodating seven sample tubes 12 (for example, tubes accommodating 50 milliliter of culture solution). The user injects a sample (for example, blood or culture solution of *E. coli* and the like) into the sample tubes 12 and inserts the sample tubes 12 into holes in the racks 13. At this time, it is not possible to expect that the user can insert sample tubes into the racks 13 to achieve a precise balance between opposing buckets 9. Therefore, the accelerometer 4 monitors vibrations in the drive unit 2. It is determined that the centrifuge 1 is operating at an imbalance when signals from the accelerometer 4 exceed a predetermined threshold value, at which time the control unit 18 controls the alarm unit 19 to light an alarm, and the centrifuge 1 halts the swing-bucket rotor 8 to prevent malfunctions.

Figure 6:
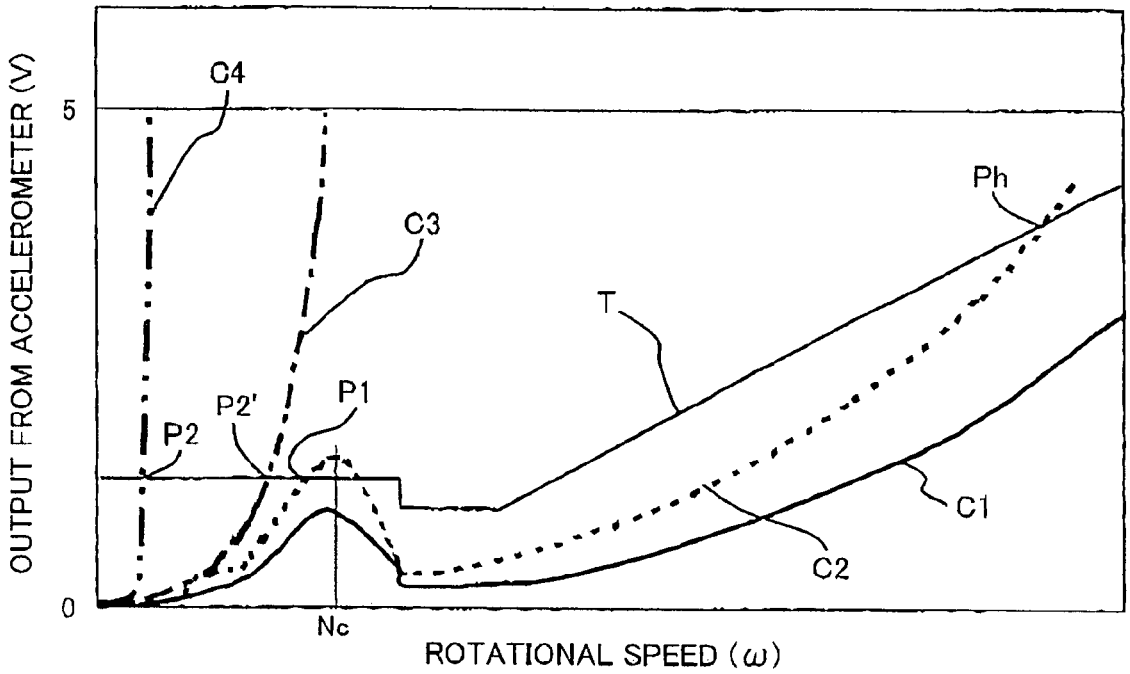
FIG. 6 is a graph showing relationships between outputs from an accelerometer and rotational speeds.

FIG. 6 is a graph showing relationships between rotational speed and output from the accelerometer 4. If the centrifuge 1 is in a balanced state and operating without problems, output from the accelerometer 4 looks like a curve C1 (the solid line). This output is below a threshold value for detecting imbalances (imbalance detection threshold represented by a curve T, which has a value greater than zero) determined in advance through experiments and the like. However, if the centrifuge 1 is imbalanced by more than the allowable amount, then vibrations caused by the imbalance increase. Thus, output from the accelerometer 4 appears like a curve C2 (the dotted line). An imbalance is detected when the output exceeds a threshold value at a point P1 near the resonance point (Nc) of the resonance caused by the mass of the drive unit 2 and the spring in the damper 5. In the event that the output from the accelerometer 4 does not exceed the threshold value near the resonance point (Nc) and the rotor is continually accelerated, an imbalance will be similarly detected when the output exceeds the threshold value at a higher velocity (a point Ph). Note that the threshold value for detecting an imbalance is set so as not to cause adverse effects to the device while the output from the accelerometer 4 does not exceed the threshold.

Figure 5:
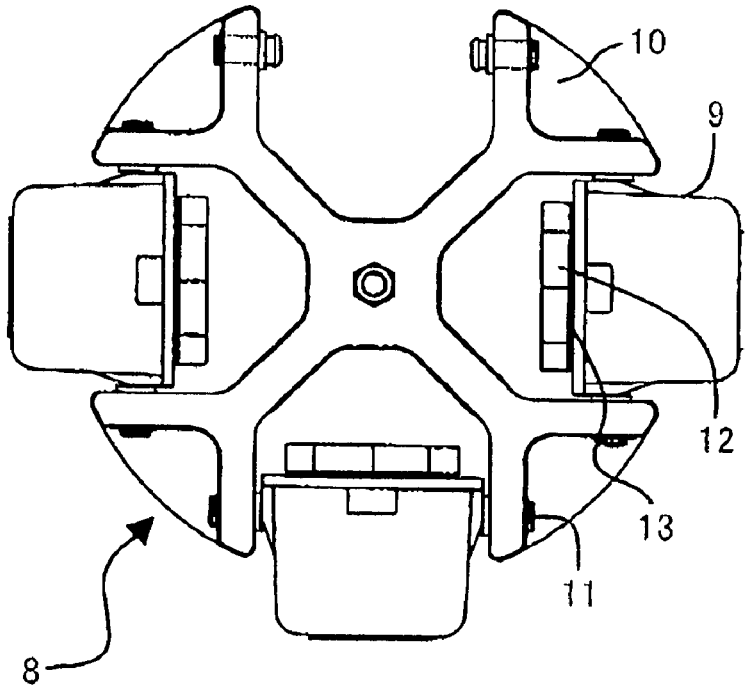
FIG. 5 is a plan view showing the centrifuge according to the first embodiment in which the swing-bucket rotor is rotated.

The above description concerns behavior of the centrifuge 1 for imbalances generated due to inconsistencies in the amount of samples in the sample tubes 12 and the number of sample tubes 12 in opposing buckets 9. In this case, most imbalances can be detected near the resonance point, even when the imbalance is large, so that the device incurs almost no damage. However, if the centrifuge 1, originally having four buckets, is operated without mounting one (or two that are not opposite each other), as shown in FIGS. 4 and 5, the amount of imbalance is considerably large. As a result, the drive unit 2 vibrates severely, even at extremely low speeds of several tens to one hundred and several tens rpm. In other words, if there is a very excessive imbalance, excessive wobbling (vibration or oscillation during rotation) can occur at extremely low speeds which is difficult to detect, even when output from the accelerometer 4 is amplified with an amplifier or the like.

In the conventional control process, increases in output from the accelerometer are slight when the rotational speed is in the very low speed range, even when the output is amplified. Accordingly, as indicated by a curve C3 (the single-dot chain line) in FIG. 6, the rotational speed continues to increase while the rotor is excessively imbalanced, until the rotational speed reaches a speed at a point P2' at which time the output exceeds a threshold value, enabling the imbalance to be detected. However, by this time, the rotating shaft has already bent and has contacted the inner surface of the rotating space in the centrifuge, causing damage to the device. In other words, the conventional control process cannot detect excessive imbalances at very low speeds due to operator errors or the like before the amount of imbalance reaches a threshold value at a point P2' and may not be able to halt the rotor before damage occurs. Hence, with the conventional control described above, the device may become damaged before an imbalance is detected. In the present embodiment, the following control process is performed for such cases when excessive imbalances occur.

As shown in FIG. 3, when an excessive imbalance occurs, the rotor wobbles (vibrates during rotation) excessively, causing the ring 15 to contact the portion 2*a* of the drive unit 2 at low speeds. As indicated by a curve C4 (the two-dot chain line) in FIG. 6, output from the accelerometer 4 increases dramatically due to the impact caused by the contact. With this sudden increase, the output reaches the imbalance detection threshold (T) at a point P2 when still at a very low speed, and imbalance in the swing-bucket rotor 8 is detected. Based on the results of this detection, the control unit 18 controls the alarm unit 19 to sound an alarm or the like in order to inform the user that an abnormality has occurred, interrupts the power source for the drive unit 2, and forcibly stops rotations of the swing-bucket rotor 8 using a halting system (not shown).

Figure 7:
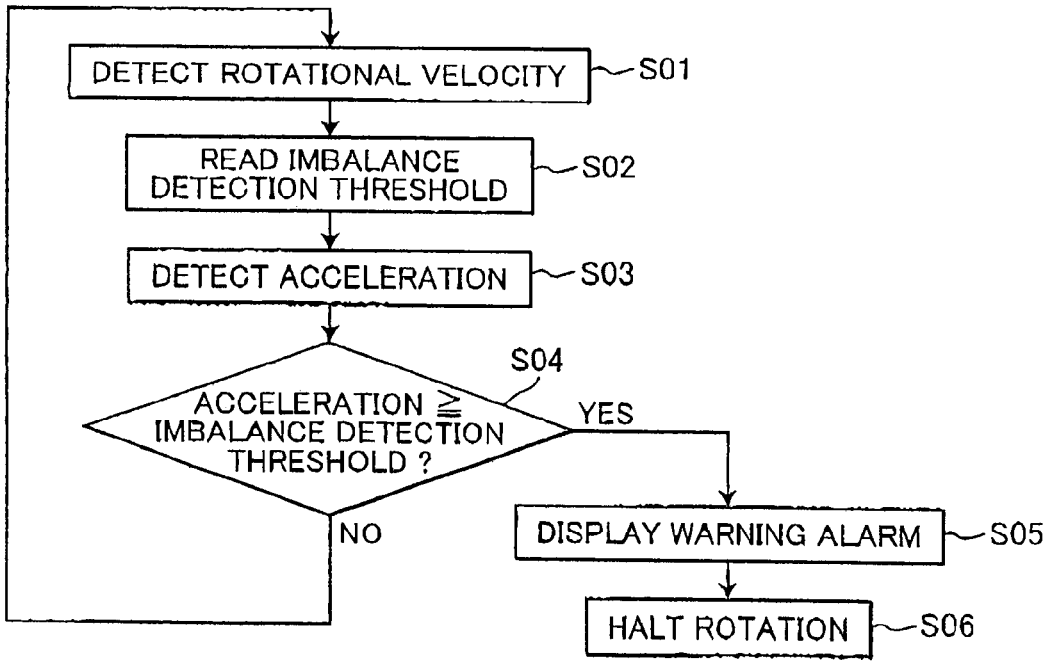
FIG. 7 is a flowchart showing a control process performed by a control unit of the centrifuge of the first embodiment in which a state of excessive imbalance occurs.

Next, the above-described control process will be described in detail with reference to the flowchart shown in FIG. 7. In Step S01 ("Step" is hereinafter referred to as "S"), the rotational speed of the drive unit 2 is measured or detected. The control unit 18 performs the measurement constantly at predetermined intervals while the centrifuge 1 is operating. In S02, the control unit 18 reads an imbalance detection threshold corresponding to the detected rotational speed from memory in the control unit 18, which stores threshold values. In S03, the control unit 18 detects output from the accelerometer 4 at the time the rotational speed of the drive unit 2 was measured.

In S04, the control unit 18 compares the output value from the accelerometer 4 with the threshold value that was read in S02. If the acceleration is less than the threshold value (S04: NO), then the control unit 18 determines that an imbalance has not occurred, and the process returns to S01 to repeat the control steps described above.

However, if the output value is greater than or equal to the threshold value (S04: YES), then the control unit 18 determines that an imbalance has occurred and, in S04, the control unit 18 displays a warning alarm. In S06, the control unit 18 halts rotation of the drive unit 2 to prevent the centrifuge 1 from becoming damaged or the like due to imbalanced operations.

While an accelerometer is used as detecting unit in the first embodiment, the detecting unit is not limited to an accelerometer, but may be another type of sensor. For example, a seismoscope may be used as a contact (impact) detecting sensor for detecting contact between the drive unit 2 and the frame 6. With this construction, the seismoscope outputs a signal (ON state) when sensing an impact caused by contact, and does not output a signal (OFF state) when no impact is detected. Using the ON-OFF control, the control unit 18 can halt the drive unit 2 upon detecting an ON state and display a warning alarm.

Figure 8:
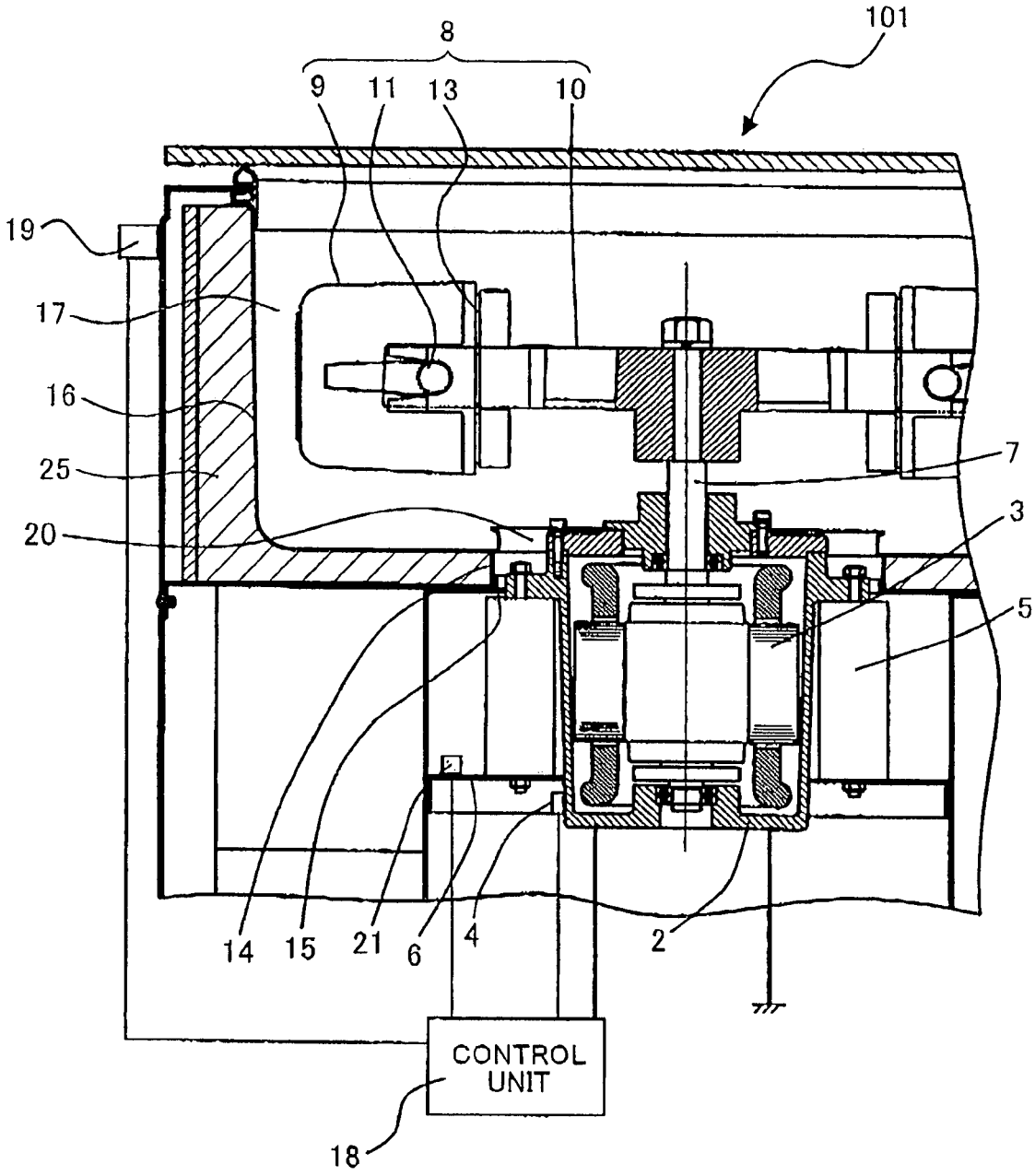
FIG. 8 is a cross-sectional view showing a centrifuge according to a second embodiment of the present invention.

Next, a centrifuge according to a second embodiment of the present invention will be described. The construction of a centrifuge 101 according to the second embodiment is basically the same as the centrifuge 1 of the first embodiment. However, as shown in FIG. 8, the centrifuge 101 is also provided with a seismoscope 21 near the damper 5 as a contact detecting sensor.

The seismoscope 21 does not detect vibrations in the drive unit 2 that are commonly generated when in a commonly occurring (not excessive) imbalanced state. However, the seismoscope 21 is adjusted to detect impacts generated when the drive unit 2 contacts the ring 15 when in an excessively imbalanced state.

The control process performed by the centrifuge 101 using the seismoscope 21 will be described next. However, the control process employed for commonly occurring imbalances will not be described as the process is identical to that described in the first embodiment.

When excessive imbalances occur, as described in the first embodiment, the accelerometer 4 detects impacts caused when the portion 2*a* of the drive unit 2 contacts the ring 15 because of vibration occurring due to the excessive imbalance. If the accelerometer 4 successfully detects the impact in this case, then the drive unit 2 can be subsequently shutdown, as described in the first embodiment. In this case, a control step using the seismoscope 21 (S15 in FIG. 9) is not executed. However, the seismoscope 21 detects impacts in case the accelerometer 4 is unable to detect the impacts.

When an impact is not detected by the accelerometer 4 but is detected by the seismoscope 21, the control unit 18 controls the alarm unit 19 to issue a buzzer noise for notifying the user that an abnormality has occurred, shuts down the power to the drive unit 2, and forcibly halts rotation of the swing-bucket rotor 8 using a halting system (not shown).

Figure 9:
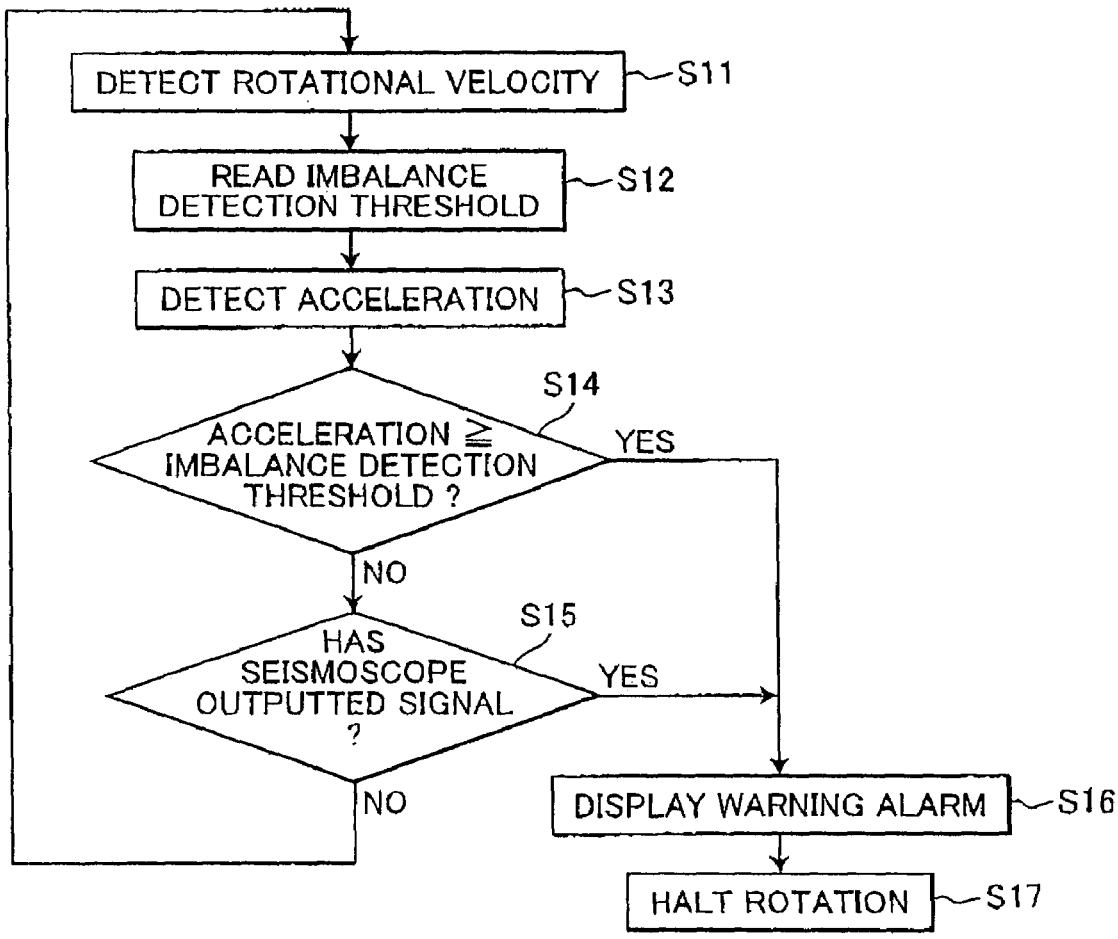
FIG. 9 is a flowchart showing a control process performed by a control unit of the centrifuge of the second embodiment in which a state of excessive imbalance occurs.

Next, the control process will be described in more detail using the flowchart shown in FIG. 9. In S11, the rotational speed of the drive unit 2 is measured or detected. The control unit 18 performs the measurement constantly at predetermined intervals while the centrifuge 101 is operating. In S12, the control unit 18 reads an imbalance detection threshold corresponding to the detected rotational speed from memory in the control unit 18, which stores threshold values. In S13, the control unit 18 detects output from the accelerometer 4 at the time the rotational speed of the drive unit 2 was measured.

In S14, the control unit 18 compares the output value from the accelerometer 4 with the threshold value that was read in S12. If the acceleration is greater than or equal to the threshold value (S14: YES), then the control unit 18 determines that an imbalance has occurred and, in S16, the control unit 18 displays a warning alarm. In S17, the control unit 18 halts rotation of the drive unit 2 to prevent the centrifuge 101 from becoming damaged or the like due to imbalanced operations. However, if output from the accelerometer 4 is less than the threshold value (S14: NO), then the process advances to S15.

In S15, the control unit 18 determines whether the seismoscope 21 has outputted a signal. If there is no output from the seismoscope 21 (S15: NO), then the control unit 18 determines that an imbalance has not occurred, and the process returns to S11 to repeat the control steps described above. However, if there has been output from the seismoscope 21 (S15: YES), then the control unit 18 determines that an imbalance has occurred and, in S16, the control unit 18 displays a warning alarm. In S17, the control unit 18 halts rotation of the drive unit 2 to prevent the centrifuge 101 from becoming damaged or the like due to imbalanced operations.

In the first and second embodiments described above, as shown in FIG. 2, a gap a is formed between the drive unit 2 and the ring 15, when there is no excessive imbalance, so that the drive unit 2 and the ring 15 do not contact each other. When the drive unit 2 does contact the ring 15, an impact greater than the normal vibrations of the drive unit 2 is applied to the accelerometer 4. However, since the ring 15 is formed of plastic, the ring 15 has an ability to absorb some of the shock. Accordingly, the impact transferred to the body of the centrifuge 1 or 101 does not cause damage to the centrifuge itself and will not startle the user.

While the invention has been described in detail with reference to the specific embodiment thereof, it would be apparent to those skilled in the art that various changes and modifications may be made therein without departing from the spirit of the invention.

For example, in the above-described embodiments, the ring 15 is disposed at the inner periphery portion 14*a* of the ring 14. However, when the force of impact caused by such contact is not great, the ring 15 may be omitted. In this case, the same effects described above can be achieved by the ring 14. Alternatively, the ring 15 may be disposed around the periphery (the portion 2*a*) of the drive unit 2.

Further, as shown in FIG. 3, in the above-described embodiments, the centrifuge 1 or 101 is constructed so that the portion 2*a* of the drive unit 2 contacts the ring 15. However, projections may be provided on either the drive unit 2 or the frame 6. Alternatively, part of the drive unit 2 or frame 6 may be formed to protrude outward so that impact caused by the contact of such protrusions can be detected. Further, the projections may be configured of elastic materials such as rubber pieces, springs, or the like.

In the second embodiment, a state of imbalance is checked using output from the seismoscope 21 after first detecting output from the accelerometer 4. However, a state of imbalance can be checked based on the seismoscope 21 first and subsequently determined based on output from the accelerometer 4. That is, it is important that a state of imbalance can be detected through the mutual operations of the accelerometer 4 and seismoscope 21. Further, control with the seismoscope 21 is performed based on whether output is ON or OFF. However, this control can be performed using an analog sensor, the output value of which changes according to the magnitude of impact as with the accelerometer.

What is claimed is:

1. A centrifuge comprising:

a frame having a first portion;

a damper supported by the frame;

a drive unit supported by the damper and generating a rotational force, the drive unit having a second portion;

a rotating member connected to the drive unit and rotated by the rotational force, imbalance of the rotating member causing the drive unit to vibrate during the rotation, the first portion and the second portion being positioned such that the second portion contacts the first portion when the vibration of the drive unit exceeds a predetermined amplitude;

a detecting unit detecting an impact caused when the second portion contacts the first portion and generating, upon the detection, an output signal; and a control unit which sets a predetermined threshold value which is greater than zero, which compares the output signal with the predetermined threshold value, and which controls the drive unit based on the output signal exceeding the predetermined threshold value which is greater than zero.

2. The centrifuge as claimed in claim 1, wherein the predetermined threshold value is determined in advance.

3. A centrifuge comprising:

a frame having a first portion;

a damper supported by the frame;

a drive unit supported by the damper and generating a rotational force, the drive unit having a second portion;

a rotating member connected to the drive unit and rotated by the rotational force, imbalance of the rotating member causing the drive unit to vibrate during the rotation, the first portion and the second portion being positioned such that the second portion contacts the first portion when the vibration of the drive unit exceeds a predetermined amplitude;

a detecting unit detecting an impact caused when the second portion contacts the first portion and generating, upon the detection, an output signal; and a control unit which sets a predetermined threshold value which is greater than zero, which compares the output signal with the predetermined threshold value, and which controls the drive unit based on the output signal;

wherein the control unit comprises a halting unit stopping the drive unit when the output signal from the detecting unit exceeds the predetermined threshold value which is greater than zero.

4. The centrifuge as claimed in claim 3, wherein the predetermined threshold value is determined in advance.

5. A centrifuge comprising:

a frame having a first portion;

a damper supported by the frame;

a drive unit supported by the damper and generating a rotational force, the drive unit having a second portion;

a rotating member connected to the drive unit and rotated by the rotational force, imbalance of the rotating member causing the drive unit to vibrate during the rotation, the first portion and the second portion being positioned such that the second portion contacts the first portion when the vibration of the drive unit exceeds a predetermined amplitude;

a detecting unit detecting an impact caused when the second portion contacts the first portion and generating, upon the detection, an output signal; and a control unit which sets a predetermined threshold value which is greater than zero, which compares the output signal with the predetermined threshold value, and which controls the drive unit based on the output signal;

wherein the control unit comprises an alerting unit issuing an alarm when the output signal from the detecting unit exceeds the predetermined threshold value which is greater than zero.

6. The centrifuge as claimed in claim 5, wherein the predetermined threshold value is determined in advance.

7. A centrifuge comprising:

a frame having a first portion;

a damper supported by the frame;

a drive unit supported by the damper and generating a rotational force, the drive unit having a second portion;

a rotating member connected to the drive unit and rotated by the rotational force, imbalance of the rotating member causing the drive unit to vibrate during the rotation, the first portion and the second portion being positioned such that the second portion contacts the first portion when the vibration of the drive unit exceeds a predetermined amplitude;

a detecting unit detecting an impact caused when the second portion contacts the first portion and generating, upon the detection, an output signal; and a control unit controlling the drive unit based on the output signal exceeding a predetermined value;

wherein the predetermined value is a threshold value which is determined in advance;

wherein the threshold value is a value of a curve which has constant portions and variable portions in dependence upon rotational speed of the rotating member.

8. The centrifuge as claimed in claim 7, wherein at least the first portion and the second portion comprises an elastic member.

9. The centrifuge as claimed in claim 7, wherein the detecting unit is an accelerometer.

10. The centrifuge as claimed in claim 7, wherein the detecting unit is a contact detecting sensor.

11. The centrifuge as claimed in claim 6, wherein the contact detecting sensor is a seismoscope.

12. The centrifuge as claimed in claim 7, wherein the detecting unit comprises both an accelerometer and a contact detecting sensor.

13. A centrifuge comprising:

a frame having a first portion;

a damper supported by the frame;

a drive unit supported by the damper and generating a rotational force, the drive unit having a second portion;

a rotating member connected to the drive unit and rotated by the rotational force, imbalance of the rotating member causing the drive unit to vibrate during the rotation, the first portion and the second portion being positioned such that the second portion contacts the first portion when the vibration of the drive unit exceeds a predetermined amplitude;

a detecting unit detecting an impact caused when the second portion contacts the first portion and generating, upon the detection, an output signal; and a control unit controlling the drive unit based on the output signal;

wherein the control unit comprises a halting unit stopping the drive unit when the output signal from the detecting unit exceeds a predetermined value;

wherein the predetermined value is a threshold value which is determined in advance;

wherein the threshold value is a value of a curve which has constant portions and variable portions in dependence upon rotational speed of the rotating member.

14. A centrifuge comprising:

a frame having a first portion;

a damper supported by the frame;

a drive unit supported by the damper and generating a rotational force, the drive unit having a second portion;

a rotating member connected to the drive unit and rotated by the rotational force, imbalance of the rotating member causing the drive unit to vibrate during the rotation, the first portion and the second portion being positioned such that the second portion contacts the first portion when the vibration of the drive unit exceeds a predetermined amplitude;

a detecting unit detecting an impact caused when the second portion contacts the first portion and generating, upon the detection, an output signal; and a control unit controlling the drive unit based on the output signal;

wherein the control unit comprises an alerting unit issuing an alarm when the output signal from the detecting unit exceeds a predetermined value;

wherein the predetermined value is a threshold value which is determined in advance;

wherein the threshold value is a value of a curve which has constant portions and variable portions in dependence upon rotational speed of the rotating member.

15. A centrifuge comprising:

a frame having a first portion;

a damper supported by the frame;

a drive unit supported by the damper and generating a rotation force, the drive unit having a second portion;

a rotating member connected to the drive unit and rotated by the rotation force wherein imbalance of the rotating member causes the drive unit to vibrate during the rotation, the first portion and the second portion being positioned such that the second portion contacts the first portion when the vibration of the drive unit exceeds a predetermined amplitude;

a detecting unit which detects an impact caused when the second portion contacts the first portion and generating, upon the detection, an output signal; and a control unit which sets a predetermined threshold value which varies in accordance with a rotational speed of the rotating member, and which enables control so as to stop the drive unit when the output signal from the detecting unit exceeds the predetermined threshold value.

16. The centrifuge as claimed in claim 15, wherein the control unit comprises an alerting unit which issues an alarm when the output signal from the detecting unit exceeds the predetermined threshold value.

* * * * *